US010654495B2

(12) United States Patent
Swoboda

(10) Patent No.: US 10,654,495 B2
(45) Date of Patent: May 19, 2020

(54) RAILWAY TRUCK BOLSTER CENTER BOWL LINER

(71) Applicant: Amsted Rail Company, Inc., Chicago, IL (US)

(72) Inventor: Anthony L. Swoboda, Villa Ridge, MO (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 408 days.

(21) Appl. No.: 15/728,169

(22) Filed: Oct. 9, 2017

(65) Prior Publication Data

US 2019/0106131 A1 Apr. 11, 2019

(51) Int. Cl.
*B61F 5/04* (2006.01)

(52) U.S. Cl.
CPC ..... *B61F 5/04* (2013.01)

(58) Field of Classification Search
CPC ..... B61F 5/04; B61F 5/16; B61F 5/18
USPC ..... 105/199.4
See application file for complete search history.

(56) References Cited

U.S. PATENT DOCUMENTS

| | | | | | |
|---|---|---|---|---|---|
| 4,224,876 | A * | 9/1980 | Larsen | B61F 5/16 | 105/199.4 |
| 4,275,661 | A * | 6/1981 | Mowles | B62D 53/0885 | 105/189 |
| 4,483,254 | A * | 11/1984 | Meadows | B61F 5/18 | 105/189 |
| 5,443,015 | A * | 8/1995 | Rudibaugh | B61F 5/16 | 105/199.4 |
| 6,324,995 | B1 * | 12/2001 | Kaufhold | B61F 5/16 | 105/199.4 |
| 2017/0021843 | A1 * | 1/2017 | Kessinger | B61F 5/06 | |
| 2017/0166223 | A1 * | 6/2017 | Warren | B61F 5/18 | |
| 2019/0106131 | A1 * | 4/2019 | Swoboda | B61F 5/04 | |

* cited by examiner

*Primary Examiner* — Jason C Smith
(74) *Attorney, Agent, or Firm* — Amsted Industries Incorporated

(57) ABSTRACT

A wear liner installs into a bolster center bowl without the need for welding. The wear liner includes an annular wall forming an open-ring shape that defines a gap between two edges of the wall. The wear liner has one or more protrusions that extend outwardly from the annular wall. The protrusions are sized to engage with a corresponding recess in the center bowl. The wear liner is compressible by drawing the annular wall toward a closed-ring configuration so that the wear liner can be inserted into the center bowl while exerting an expansive, radially outward force. Upon expanding, and the protrusions engage with the recess or recesses in the peripheral wall of the center bowl. This engagement, along with the expansive pressure of the wear liner against the peripheral wall of the center bowl secures the wear liner in place.

20 Claims, 11 Drawing Sheets

RAILWAY TRUCK BOLSTER CENTER BOWL LINER

RELATED APPLICATIONS

Not applicable.

TECHNICAL FIELD

This application relates to equipment for railway vehicles. More specifically, this application relates to bolsters and associated equipment on rail car truck assembly.

BACKGROUND

Railway vehicles traditionally include a car body that rides on top of a chassis or framework referred to as a truck, which serve as a modular subassembly of wheels and axles. A traditional rail truck includes two side frames that run parallel to the direction of travel of the truck. A pair of wheel sets span between and support each side frame at respective end locations. Each wheel set includes an axle that runs generally perpendicular to the side frames, and a pair of wheels at each end of the axle. A bolster also spans across the side frames, typically in a central location of the truck, linking the side frames together. The bolster is also used to support or carry the car body, often via a bowl assembly (called a center bowl), positioned on an upper surface at the center of the bolster.

The center bowl serves as a mating structure that interacts with a corresponding connector or draft sill structure on the bottom of the car body. For example, the bolster center bowl may receive and support a protruding circular center plate of a draft sill that is associated with the car body, thereby providing a bearing surface that supports the car body on the truck bolster. Bolsters may utilize wear liners to improve the wear characteristics and extend the service life of the bolster. For instance, the bolster may utilize a horizontal wear plate that spans a bottom surface of the center bowl and a vertical wear ring that circumscribes an interior circumference of the bowl to absorb wear and tear that results at the interface with the rail car connector. In this way, the wear liners can be replaced piecemeal when wear becomes significant, as opposed to changing out the entire bolster. Often times, these wear liners are welded to the center bowl, which makes the replacement process difficult and time consuming.

SUMMARY

This application describes examples of a wear liner that is installable into the center bowl of a bolster. The wear liner includes an annular wall that is wound from a band to form an open-ring (or split-ring) shape in a neutral state. This open-ring shape defines a gap or separation between two edges of the wall. The wear liner has one or more protrusions that extend outwardly from the annular wall. Any protrusions are sized to engage with a corresponding recess provided in the center bowl. The open-ring shape provides the wear liner with spring-like properties, allowing the wear liner to be compressed by drawing the annular wall toward a compressed or closed-ring configuration (e.g., drawing the two edges of the wall toward one another and reducing the overall diameter of the annular wall), while maintaining a tendency to expand. That is, when compressed, the wear liner will exert an expansive, radially outward force. In the compressed state, the outer diameter of the wear liner is also reduced compared to the neutral, un-compressed configuration. This allows the compressed wear liner to be inserted into the center bowl, which may have an inner diameter less than that of the wear liner in the neutral state. Upon being placed in the center bowl and released from compression, the wear liner expands, and the protrusion(s) engage with the recess(es) in the peripheral wall of the center bowl. This engagement, along with the expansive pressure of the wear liner against the peripheral wall of the center bowl secures the wear liner in place. Thus, the installation can be secure the wear liner in place in the center bowl without the use of welding, making the removal and/or replacement process more efficient.

DETAILED DESCRIPTION

Figure 1:
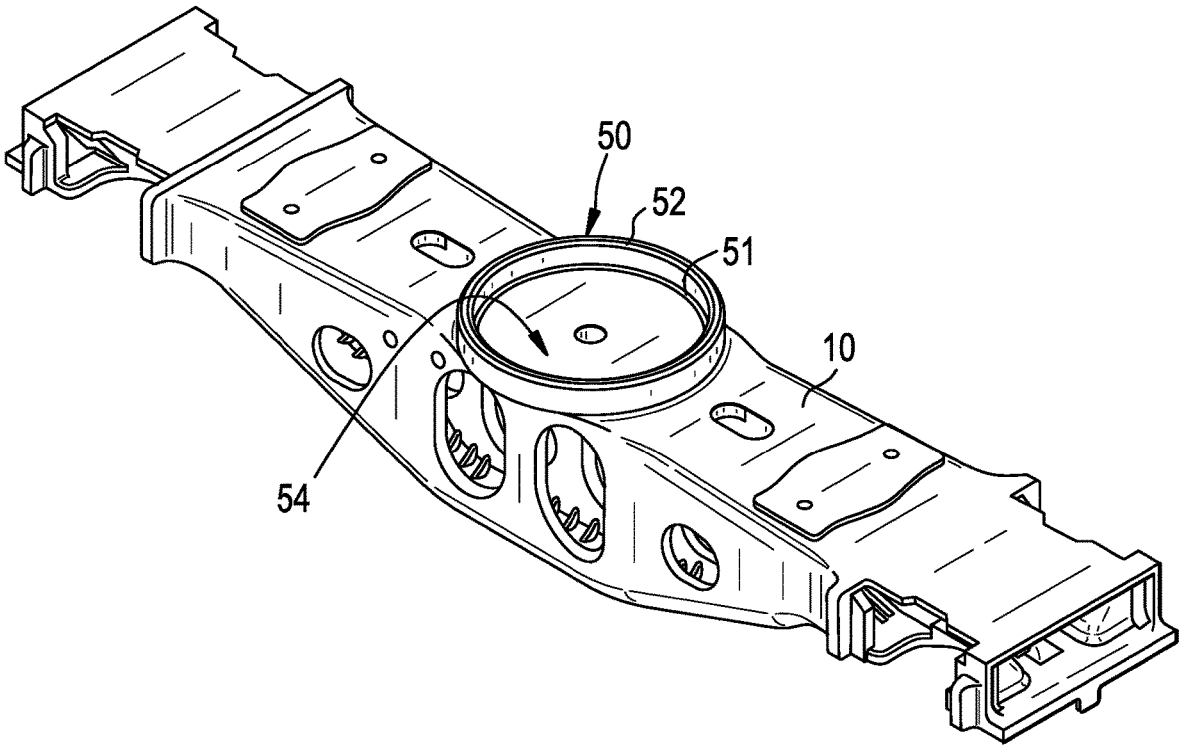
FIG. 1 is a perspective view of a railway truck bolster with a center bowl that used in connection with examples described in this application.

This application describes a wear liner for a center bowl of a rail truck bolster. The wear liner is designed to be removable and replaceable in the center bowl. For instance, the wear liner may "snap" into place in the center bowl such that it can secured without the use of welding. A "snap" or "snap-in" configuration, as used throughout this application, refers to a liner that secures itself into position using spring-like characteristics in the liner and mating structural components in the liner and center bowl.

Typically, wear liners are secured in place in the center bowl via welding. For instance, the top surface of the center bowl and liner can be welded together, securing the liner into place. The welds ensure that the wear ring stays immobile during operation. Over time, the wear ring will deteriorate to the point that it warrants replacement. To replace the wear liners, the truck is removed from the railcar and the used wear ring is removed. The truck bolster center bowl surface is then cleaned up through grinding and a new wear ring is welded into place.

The welding of a wear liner is a time consuming and expensive process. Further, the removal and replacement of the welded wear liners often involves use of a torch cut, which can involve the use of sophisticated equipment, and can be time consuming and expensive. Providing the snap-in configuration of the liners described herein allows for a much more efficient and convenient replacement process, while still allowing for a safe and secure fit between the wear liner and the center bowl.

The described wear liners are formed from a band of material, typically a metal such as steel. The band has opposing edges and an upper and lower surface. The band is wound about an axis to form an open-ring configuration. That is, the band is wound to form a partial circle or ring, with the two opposing edges defining a space or a gap in the ring. The wound ring is resilient but somewhat flexible, such that the ring can be elastically compressed via a radially inward compression force that forces the two opposing edges toward one another. This compression causes the diameter of the liner to decrease, but establishes a potential energy in the liner, similar to that of a compressed spring.

Upon placing the compressed liner into a center bowl and releasing the compressive force, the liner will tend to expand toward the original un-compressed configuration. Where the liner has a shape that operates with a center bowl, the compressed diameter of the liner will be less than the inner diameter of the center bowl, but upon releasing the compressive force, the outer surface of the liner will exert a radially outward force against the inner wall of the center bowl. This radially outward force will help maintain the liner in place in the bowl.

Additionally, the liner may be equipped with various protrusions, tabs, or other mating structures that operate in connection with recesses (or corresponding mating structures) in the center bowl to further secure the liner in place. In this way, the protrusions can "snap" into place in the center bowl, allowing the liner to be easily installed without the use of welding. Along these lines, the center bowl can be removed or uninstalled by compressing the liner, withdrawing the protrusions from the corresponding recesses in the center bowl, and then removing the liner. This installation can be done effectively without the use of welding equipment.

Figure 2:
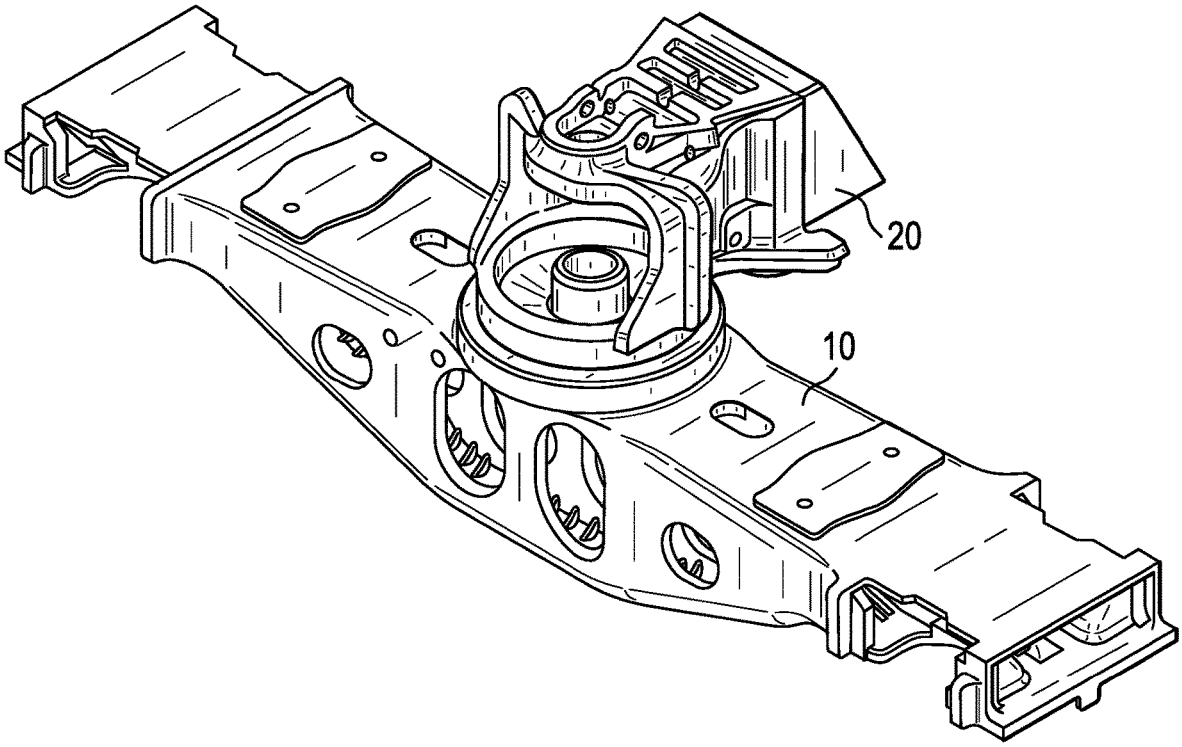
FIG. 2 shows a connector attached to the center bowl bolster of FIG. 1.
Figure 3:
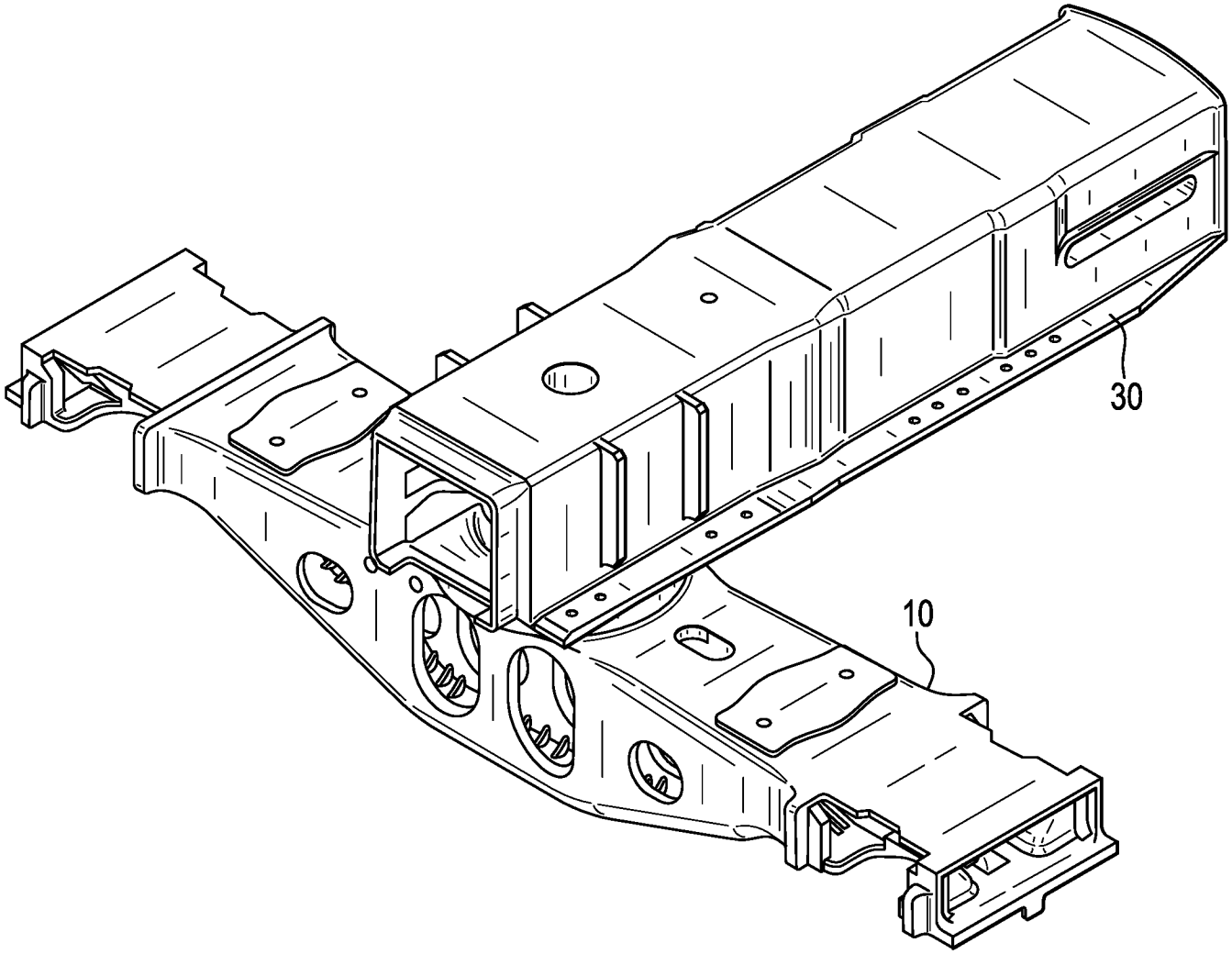
FIG. 3 shows a draft sill attached to the center bowl bolster of FIG. 1.

FIG. 1 is a perspective view of a railway truck bolster 10 with a center bowl 50. Railroad freight truck assemblies often utilize a truck bolster 50 that is coupled to an articulated connector 20, as shown in FIG. 2, or to a draft sill 30, as shown in FIG. 3. The bolster 10 supports the weight of the railcar and provides the connection between truck assembly and freight car. The truck bolster 10 includes a center bowl 50 located in a central location of the truck bolster 10.

Figure 4A:
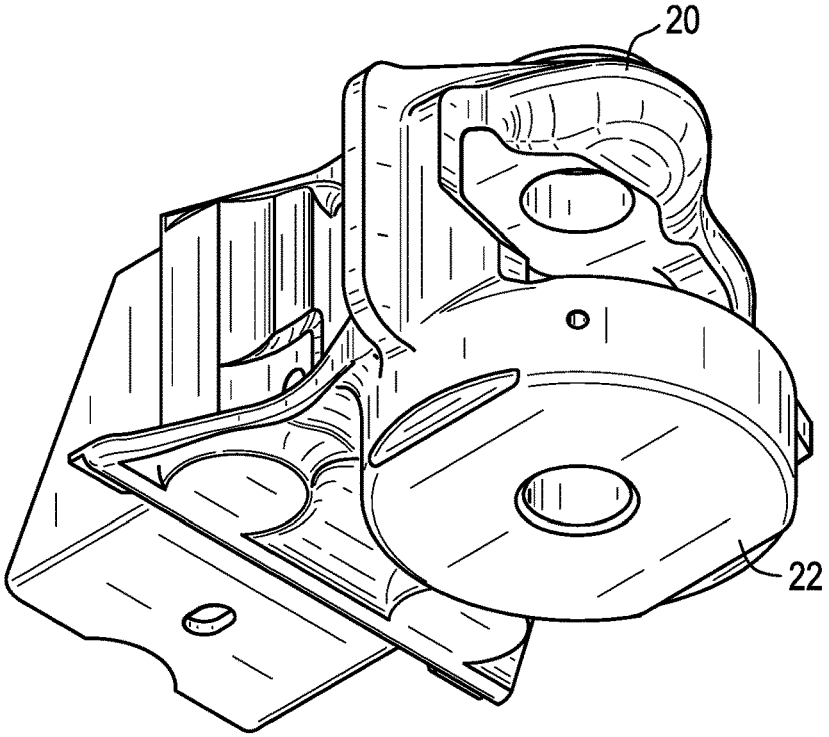
FIGS. 4A and 4B show center plates on the undersides of the connector of FIG. 2 and the draft sill of FIG. 3, respectively.
Figure 4B:
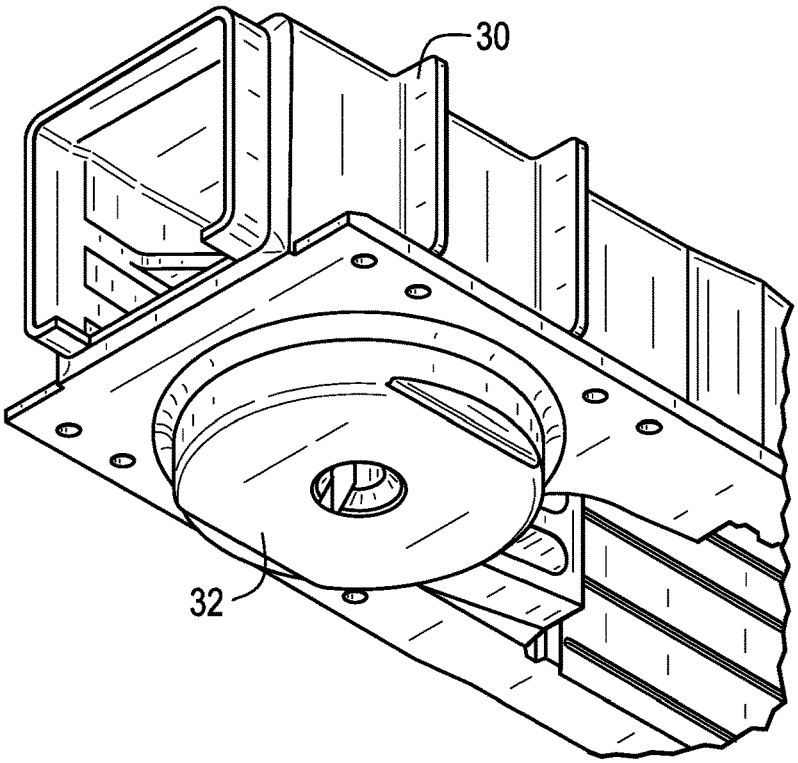

The center bowl 50 includes an outer peripheral wall 52, which circumscribes the outer circumference of the center bowl 50 and intersects the lower surface 54 of the center bowl 50 at a junction point 51. The center bowl 50 acts as the female portion of the truck to railcar connection, with the corresponding portion of the connector 20 or draft sill 30 acting as the male portion of the connection. FIG. 4A shows the underside of the connector 20 of FIG. 2, and FIG. 4B shows the underside of the draft sill 30 of FIG. 3. Each underside includes a center plate 22/32, which is placed into the center bowl 50 of the bolster 10 to complete the connection of the truck to railcar. Via this connection, the rail car can pivot at this point of the connection, for instance, when the railcar encounters curves in a track upon which it is traveling.

This connection can be exposed to significant wear and tear as the rail car operates. In particular, the vibration of the rail car and the exposure to repeated push and pull forces at the connection, accelerates the wear of components at this point. To inhibit the wear of critical components, bolsters include a sacrificial wear ring, or wear liner within the center bowl 50. The wear liners are typically inserted within the center bowl, along an interior surface of the peripheral wall 52 of the center bowl 50. In this way, the liner can absorb a significant amount of the wear and other damage that may result from the forces on the connection. In time, the wear liner can be replaced, which allows the center bowl 50 and the bolster 10 to have a longer operating life.

Figure 5A:
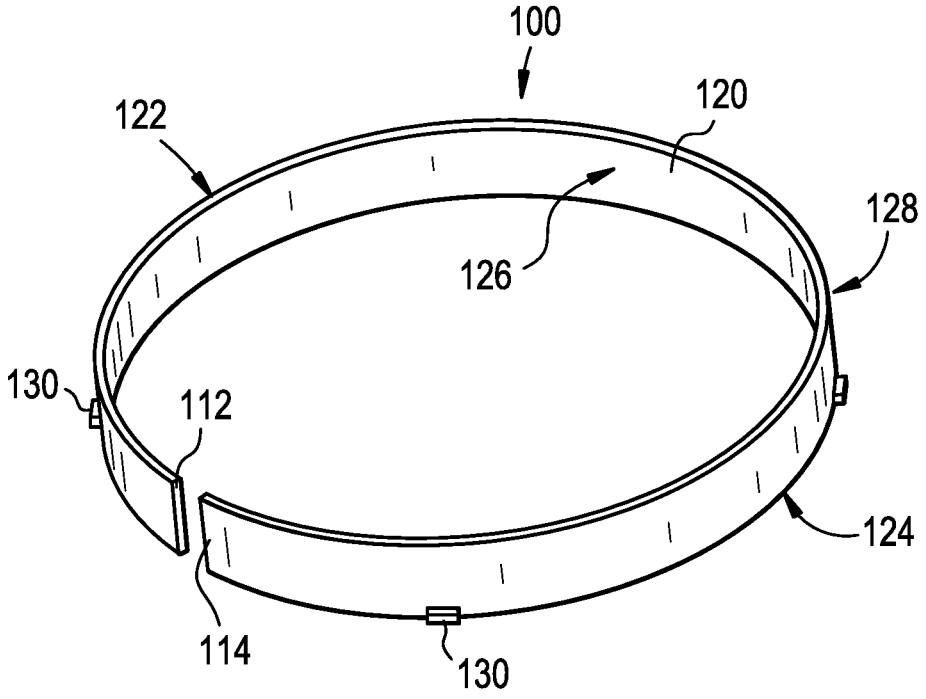
FIGS. 5A and 5B are isometric and top views, respectively, of an example of a wear liner described in this application.
Figure 5B:
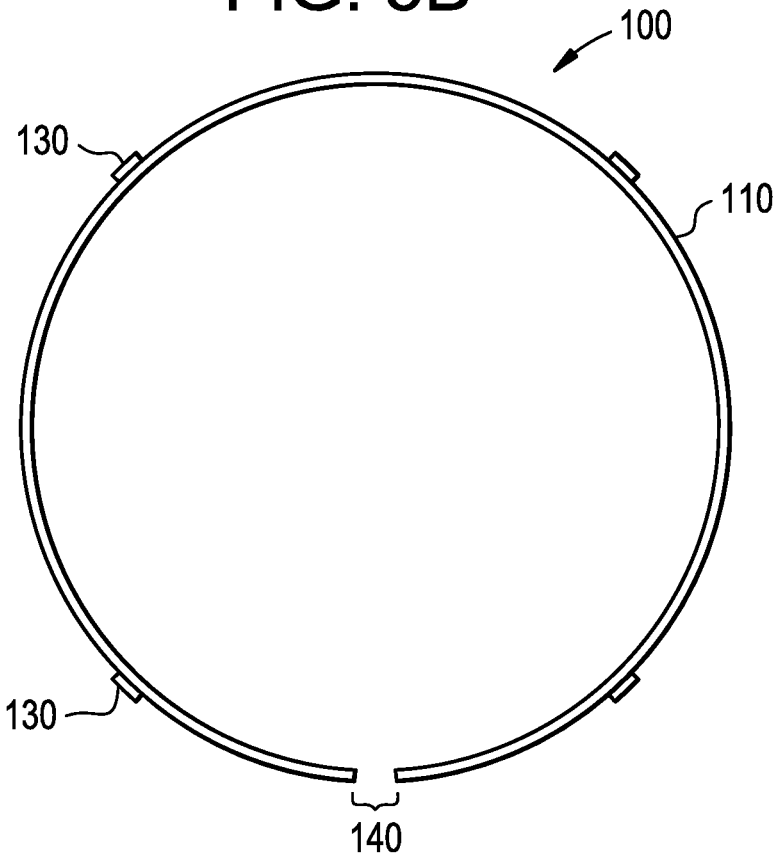

FIGS. 5A and 5B are isometric and top views of a wear liner 100 that uses in the snap-in configuration described herein. The liner 100 is formed from a band of material, which may include a metal such as steel. In some examples, the materials used in the wear liner 100 can include 304 Stainless steel, Austenitic Manganese Steel, and/or Hadfield Grade Austenitic Manganese Steel. Further, materials in compliance with the Association of American Railroads (AAR) standard S-306 could also be used to form the wear liner 100.

The dimensions of the wear liner 100 can vary depending on the intended use and the corresponding center bowl that it will be used with. In some examples, the outer diameter of the liner 100 when installed in the bolster will be about 14.5 inches, or about 16.5 inches. The wall thickness of the liner may be about 0.25 inches, thereby giving the aforementioned liners an inner diameter of about 14.0 inches and 16.0 inches, respectively. The height of the liner 100 (or the width of the band 110) can be about 1.125 inches, about 1.375 inches, about 2.0 inches, or about 2.250 inches, depending on bolster style.

The band 100 has a first edge 112 and an opposing second edge 112, and is wound about an axis to form a partial ring configuration. That is, the band 110 is wound to form a near circle-type shape, but with the opposing edges 112 and 114 defining a gap 140 or separation, which forms the split in the split ring shape in a neutral configuration. The neutral configuration is the configuration of the liner 100 when it is not exposed to external compressive forces. That is, it is the natural resting shape and configuration of the liner 100. The size of the gap 140 in the neutral, uncompressed state can vary depending on the intended use of the liner 100, and can also be adjusted from liner to liner as a way to be control the elastic spring force necessary to retain the liner during service. In many embodiments, the gap 140 of the ring liner in the compressed/installed configuration can be small, minimal, or even nonexistent.

The size of the gap 140 and the separation between the opposing edges 112 and 114 can vary depending on a variety of factors, including the thickness of the band 110, the diameter of the liner 100, the stiffness and elasticity of the material forming the liner 100, and the diameter of the corresponding center bowl.

The band 110 is wound to form a vertical annular wall 120 of the liner. The annular wall 120 has an upper rim 122 and an opposing lower rim 124, an inner surface 126 and an opposing outer surface 128. Protruding from of the outer surface 128, along the lower rim 124, are a series of protrusions 130 or tabs. The tabs are designed to engage with a corresponding recess on the center bowl to help secure the liner in place. The dimensions of the protrusions 130 can vary depending on the application and intended use, and in particular, depending on the structure of the center bowl that it is designed to work with. In some examples, the protrusions 130 can have a width (the dimension parallel to the tangent of the liner) of about 0.75 inches, a height of about 0.25 inches, and a thickness (the dimension perpendicular to the tangent) of about 0.25 inches.

The embodiment shown in FIGS. 5A and 5B show four protrusions 130 on the liner 100, each protruding outwardly from the lower rim 124 of the wall 120. It should be understood that other embodiments may employ different configurations, for instance, with more (e.g., five, eight, ten) or fewer (e.g., one, two, three) protrusions 130 than shown in the figures. Further, protrusions 130 can have different sizes or shapes, or extend from other locations of the liner, including along the upper rim 122, or a central location on the outer surface 128 of the annular wall 120. The configuration will depend on the corresponding center bowl structure that the liner 100 is designed to engage with.

The liner 100 is compressible to a compressed configuration. In the compressed configuration, an external compressive force applies a force on the liner that draws the two edges 112 and 114 toward one another, thereby reducing the size of, or even eliminating the gap 140 there between. Thus, the liner 100 has a diameter in the compressed configuration that is smaller than that in the neutral configuration. Moreover, in the compressed configuration, the liner 100 has a tendency to spring or expand back to the neutral configuration, and thus exerts a radially outward force or pressure on the center bowl peripheral wall. This outward force helps secure the liner 100 against the outer wall of the center bowl once installed.

Figure 6:
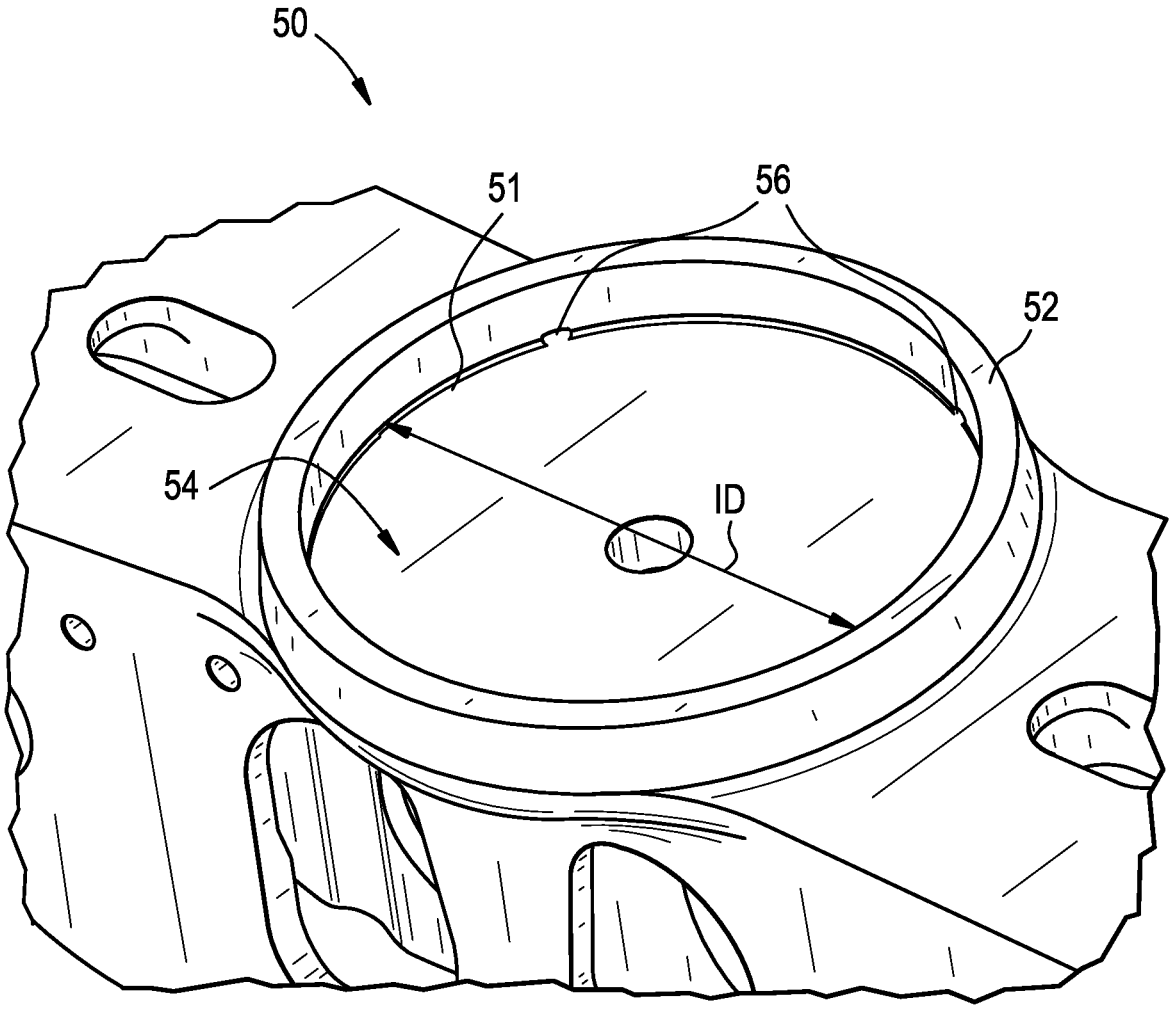
FIG. 6 is a close up of a center bowl that operates in connection with the wear liner of FIGS. 5A and 5B.

FIG. 6 is a close up of a center bowl 50 configured to operate in connection with the wear liner 100 of FIGS. 5A and 5B. The center bowl 50 includes an annular peripheral wall 52 that surrounds and defines the outer perimeter of the bowl 50. The bowl 50 has a surface 54 that forms the lower portion of the bowl 50. The peripheral wall 52 rises from the lower surface 54 from a junction 51. At this junction point 51, the center bowl comprises various recesses 56, which are designed to engage with the tabs or protrusions 130 on the liner 100. These recesses 56 are shown as slots similar in size to the protrusions 130, but in some examples, the recesses 56 could be significantly larger. In fact, in some embodiments, such as those depicted in FIGS. 8A, 8B, and 9, the recess may forms a single groove 256 that extends around or mostly around the perimeter of the center bowl 250.

The center bowl has an inner diameter (ID) measured from the interior surface of the peripheral wall 52. This inner diameter is large enough to receive the liner 100 in the compressed configuration, but in some examples is small enough so that the liner 100 in the neutral configuration is too large to be inserted therein. Thus, in such an example, the liner 100 must be compressed before being installed. In some examples, the center bowl can be cast or machined to have an ID of about 14.500 inches or about 1.5 inches. In some instances, the tolerance for this ID can be set to be about +0.125"/−0.000". Upon installation, the compressive force on the liner 100 will be released, and the liner 100 will exert an expansive force, tending to return to the neutral configuration. This expansive force will cause the outer surface 128 of the liner 100 to exert a force on the inner surface of the peripheral wall 52 of the center bowl 50, and help secure the protrusions 130 in place within the corresponding recesses 56. The expansive force along with the placement of the protrusions in the center bowl 50 help secure the liner 100 in place without the need for additional welding.

Figure 7:
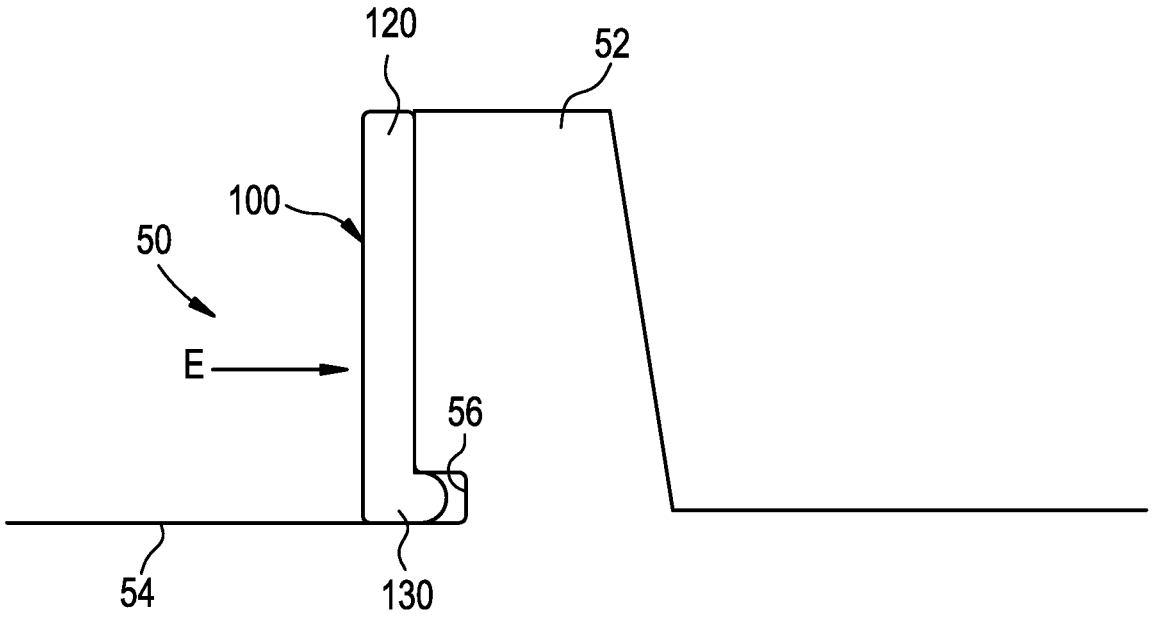
FIG. 7 is a side cross sectional view taken through one segment of a wear liner installed in a center bowl of a bolster in accordance with examples described herein.

The engagement between the protrusions 130 and the recesses helps secure the liner in place, as shown in FIG. 7. FIG. 7 is a side cross sectional view taken through one segment of the wear liner 100 installed in the center bowl 50. As shown in this cross section, the protrusion 130 extending from the lower portion of the vertical wall 120 of the wear liner 100 is guided into the recess 56 along the lower portion of the peripheral wall 52 of the center bowl 50. This engagement helps secure the liner 100 along the lower surface 54 of the center bowl 50 and inhibits upward movement of the liner 100. The expansive force E, generated by the tendency of the compressed liner 100 to return to the neutral configuration helps maintain the position of the protrusion 130 in the recess 56, and also inhibits the upward migration of the liner 100, even where the liner 100 is not welded into the center bowl 50.

Figure 8A:
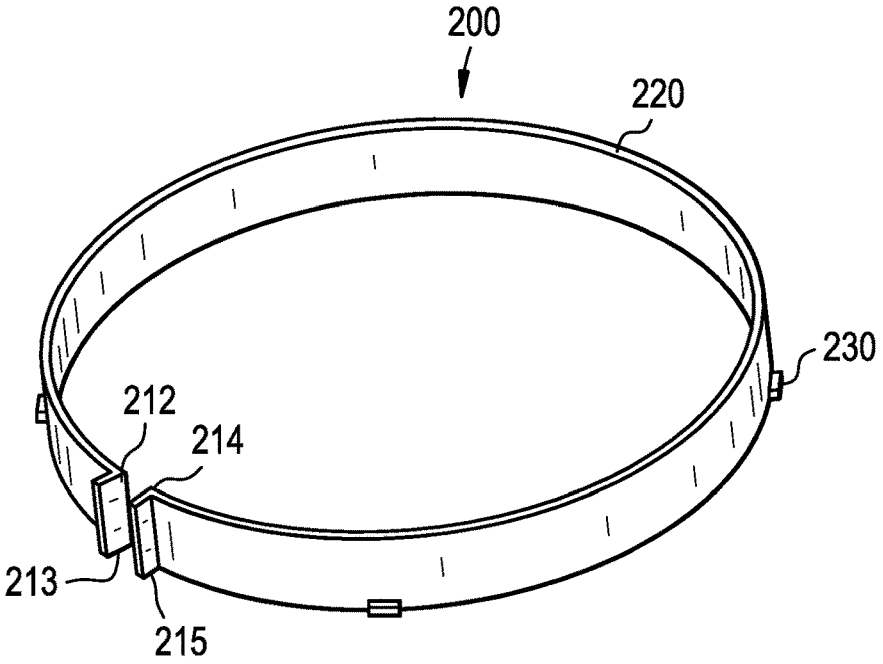
FIGS. 8A and 8B are isometric and top views, respectively, of an example of a wear liner with anti-rotation tabs described in this application.
Figure 8B:
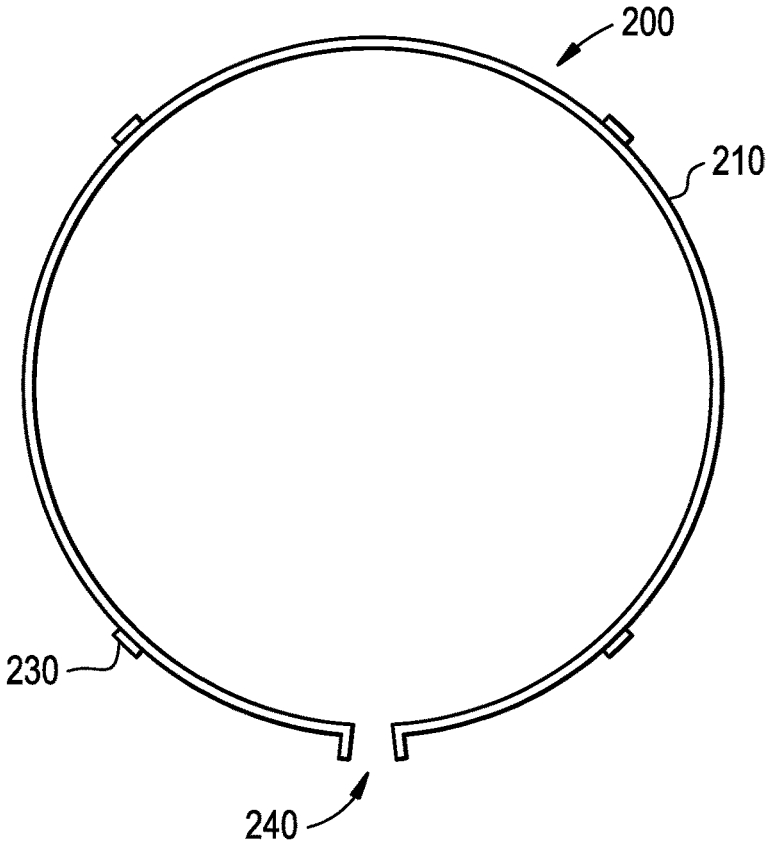

FIGS. 8A and 8B show another example of a wear liner 200 with anti-rotation tabs 213/215 that further inhibit radial motion or rotation of the wear liner 200 in the center bowl. As shown, the wear liner 200 has a vertical wall 220 with protrusions 230 extending outwardly therefrom. The opposing edges 212/214 of the vertical wall 220 define the gap or space in the split ring shape of the liner 200 in the neutral configuration. Two tabs 213 and 215 extend outwardly from the respective edges 212 and 214. These tabs 213/214 can serve as a gripping surface that facilitates the compression of the liner 200, for example, by allowing compression tools to grip the liner and squeeze the edges 212/214 toward one another to compress the liner 200.

The liner 200 can be compressed via a variety of different techniques, depending on the ring design, the center bowl design, and the intended use. Some examples may employ large tongue-and-groove pliers, or large inside snap ring pliers to facilitate the compression. In other examples, a robotic system could be used to compress the liner in an automated process. In some examples, the ring can be inserted by hand without the use of special tools. For instance, an operator may insert one end of the ring into the bottom of the center bowl of the bolster, and continue to work the ring down into the center bowl in a circular motion. Removing the liner can be assisted via the use of a pry bar, which can help wedge the liner out of the bowl.

Figure 9:
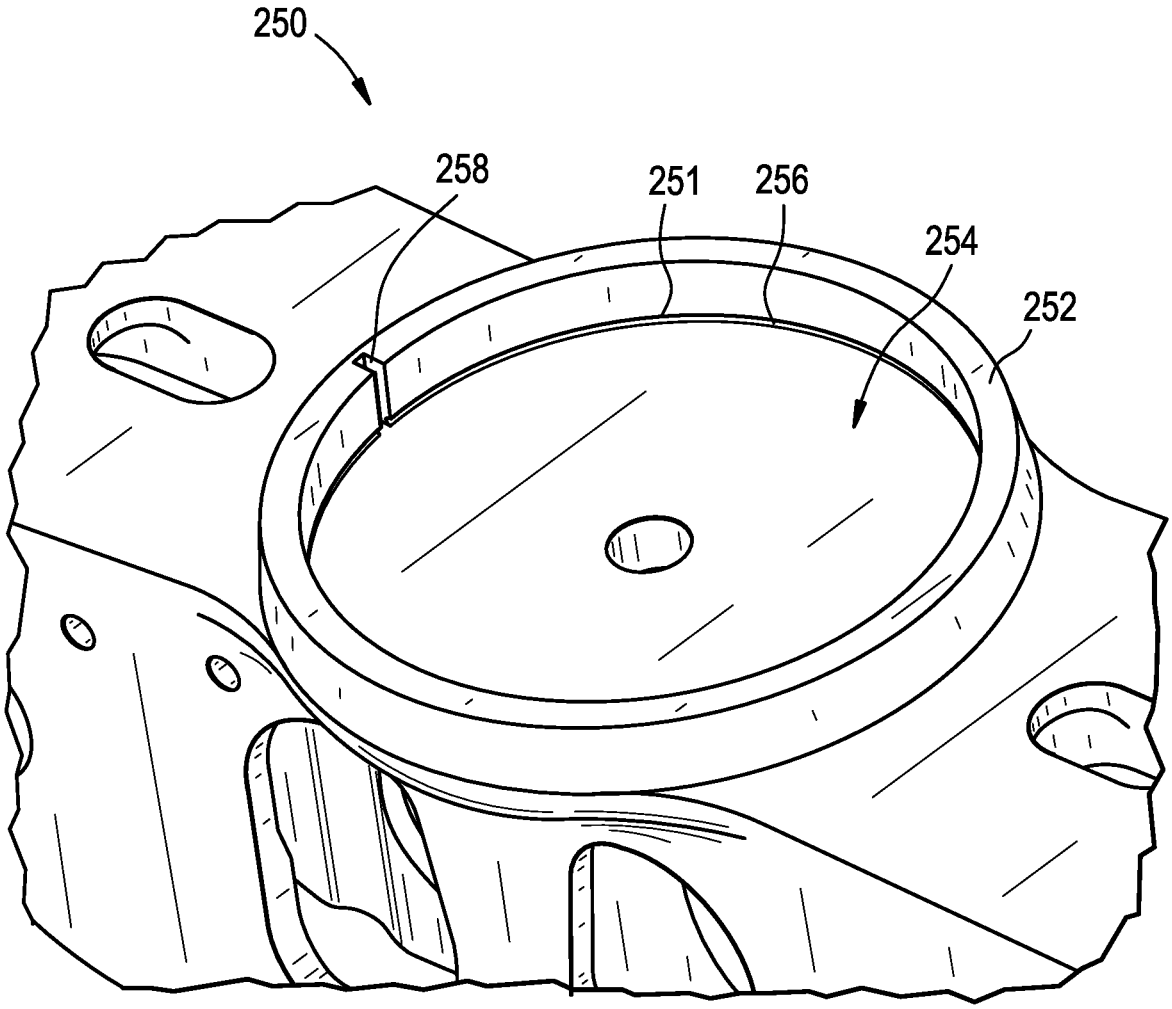
FIG. 9 is a close up of a center bowl with a notch that operates in connection with the wear liner with anti-rotation tabs of FIGS. 8A and 8B.

FIG. 9 is a close up of a center bowl 250 with a notch 258 that operates in connection with the wear liner 200 having the anti-rotation tabs 213 and 215. As discussed above, the center bowl 250 comprises a continuous groove 260 along the junction 251 between the lower surface 254 and the peripheral wall 252 of the center bowl. The use of such a groove 250 may be employed, for example, if the center bowl 250 is machined, rather than cored. In situations where the center bowl is cored, rather than the machined groove, the center bowl may employ a plurality of slots 56 as shown with respect to FIG. 6.

The notch 258 is configured to correspond to the anti-rotation tabs 213/215 of the liner 200. That is, the notch is vertical and essentially parallel to the tabs 213/215. In some examples, such as the one shown in FIG. 9, the notch has a width that is slightly greater than the combined width of the tabs 213 and 215 so that both tabs can be pressed together and inserted into the notch. In this way, the notch can inhibit the rotation of the liner 200 within the center bowl 250.

In other examples, depending on the intended application, the notch may have a width configured to receive only one of the anti-rotation tabs 213 or 215. In such an example, the peripheral wall 252 may include two separate notches, each one configured to correspond to each of the anti-rotation tabs 213/215. In this embodiment, the liner 200 may be arranged to be installed in a configuration that is less than fully compressed (e.g., the edges 212 and 214 are not pressed into contact with one another). Alternatively, the anti-rotation tabs 213/215 may extend from portions of the liner that are not at the edges 212/214 that define the gap 240. In either event, the notch/notches 258 secure the anti-rotation tabs 213/215 in a radial position so that radial forces will not result in a rotation of the liner 200 within the center bowl 200.

The notch configuration of FIGS. 8A-10B can also be employed with respect to the multi-recessed cored center bowl configuration of FIGS. 5A-7, though it may not be necessary, as the multiple smaller recesses can serve to inhibit the rotation of the liner without the use of anti-rotation tabs or a corresponding notch. Nevertheless, such features may still be used to provide a gripping surface by which the liner can be easily compressed using compression tools.

Figure 10A:
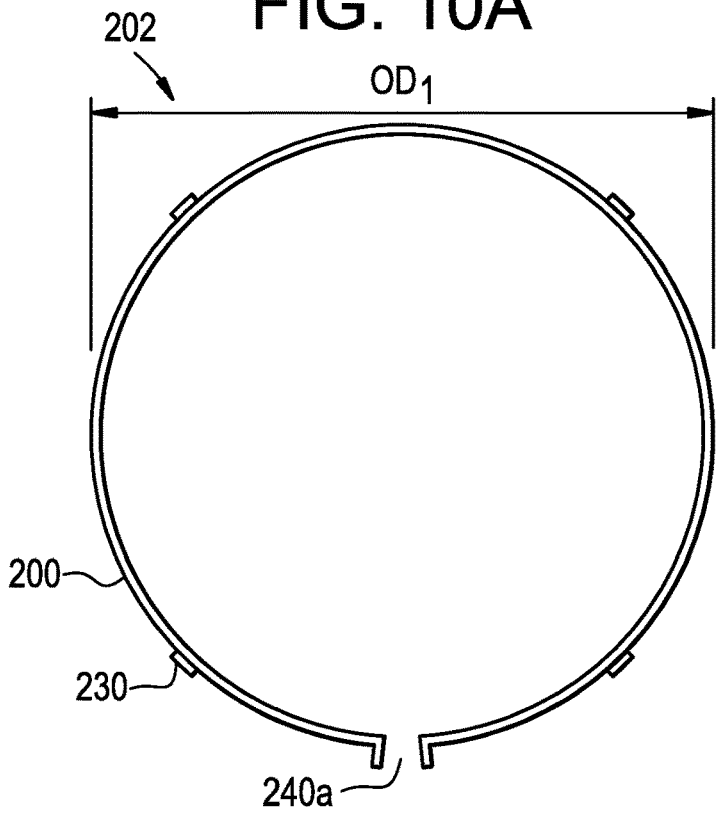
FIG. 10A shows the wear liner of FIGS. 8A and 8B in a neutral, uncompressed state.
Figure 10B:
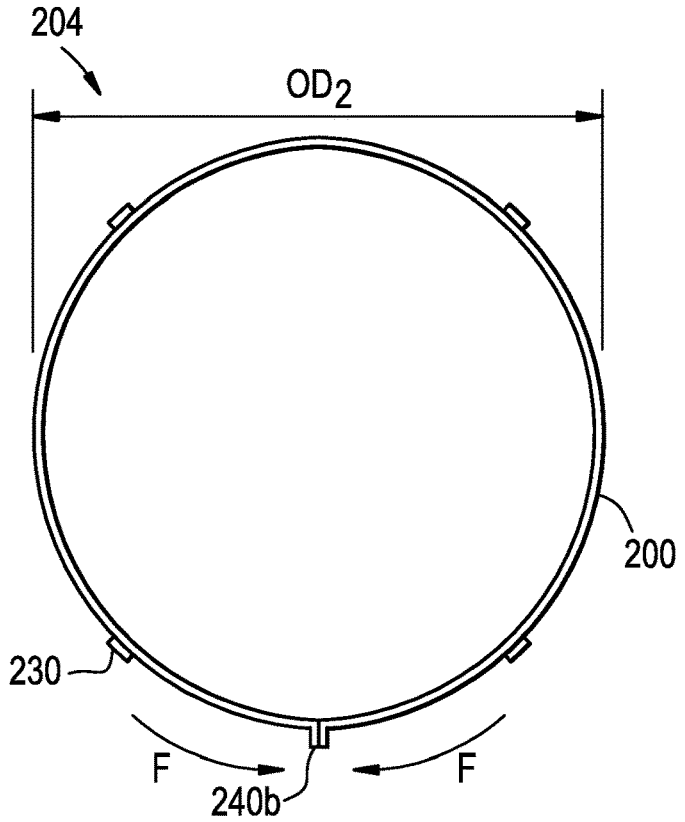
FIG. 10B shows the wear liner of FIG. 10A in a compressed state.

FIGS. 10A and 10B show the wear liner 200 in both the neutral configuration 202 (FIG. 10A) and the compressed configuration 204 (FIG. 10B). In the neutral configuration 202, no external forces are acting upon the liner, thus, a gap 240 or separation exists between the edges of the liner. In the compressed configuration 204, an external compressive force F is applied to the liner to draw the edges toward one another and narrow the size of the gap 240*b*. The force necessary to compress the liner can be configured such that it is low enough for a single operator to manage the compression (either with or without the assistance of tools or machines), but strong enough to exert a radially outward force sufficient to hold the liner in place. In some forms, the gap 240*b* of the compressed configuration 204 may be non-existent or virtually non-existent, as the edges are drawn into contact with one another. In this way, the outer diameter $OD_2$ in the compressed configuration 204 is less than the outer diameter $OD_1$ of the liner in the neutral configuration 202.

In some instances, the liner is configured so that the $OD_1$ is greater than the inner diameter of the corresponding center bowl, such that the liner cannot be installed unless it is compressed. The outer diameter $OD_2$ of the compressed configuration is smaller than the inner diameter of the corresponding center bowl, so that when the force F is removed from the liner, the liner will expand, and exert a radial outward pressure or force on the peripheral wall of the center bowl.

The examples described above show liners and center bowls with protrusions and corresponding recesses and notches to help secure the snap in liner in position in the center bowl. Other configurations may employ other features that further help secure the liners in position by providing other modes of support. For example, the protrusion and recess configuration of the liner and bowl may allow for a bayonet-type configuration, such that the liner is first installed, then rotated into position before being released, thereby providing an arduous escape path for the protrusion. In this way, vibrations and other factors that may tend to cause unpredicted movement in the liner will be less likely to cause the liner to release or move out of the installed position.

The liners described herein can be formed from a variety of different materials; however, many embodiments involve the use of liners made from metal materials, such as steel. Such materials will increase the durability of the liners, while maintaining the structural support necessary for supporting the rail car. However, depending on the intended operation, other materials may be applied as well. For instance, the liners may be coated or dipped in polymer materials such as rubber or plastic to facilitate installation of the liner in the center bowl. The liners may be enforced with additional metals or polymers to modify the flexibility of the liner, which can effect the value of the compressive and expansive force of the liner.

Figure 11:
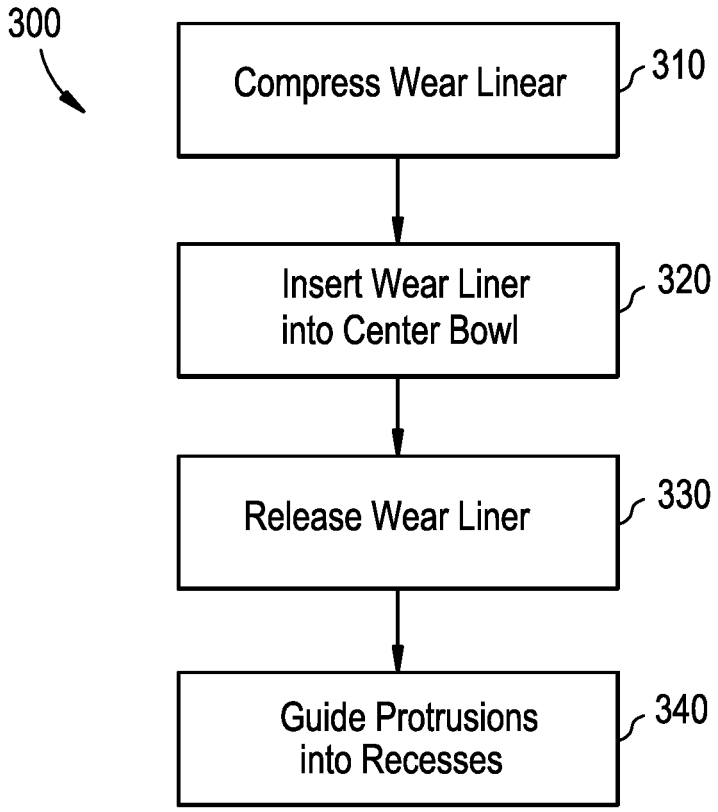
FIG. 11 is a flow diagram of a method for installing a wear liner in the center bowl of a bolster in accordance with examples described in this application.

This application also describes methods of installing a liner in a bolster center bowl. FIG. 11 is a flow diagram of a method 300 for installing a wear liner in the center bowl of a bolster that is configured to engage with a corresponding mating component of a car body. The center bowl can have a configuration similar to one of those described above with respect to FIGS. 6 and 9. For instance, the center bowl may have a peripheral wall with at least one recess. The wear liner may have one of the configurations described above with respect to FIGS. 5A, 5B, 8A, 8B, 10A, and 10B. For example, the liner may have a vertical annular wall with a gap defined between two wall ends and at least one protrusion extending outwardly from the vertical annular wall.

The method involves compressing 310 the wear liner by pressing the two wall ends toward one another to reduce the size of the gap and the outer diameter of the vertical annular wall. The compressing can be performed via tools configured to apply a compressive force on the liner to reduce the size of, or eliminate the gap in the vertical annular wall. The compressing reduces the diameter of the wear liner.

Once compressed, the diameter of the wear liner is less than the inner diameter of the center bowl, and the liner can be inserted 320 into the center bowl. The wear liner can be aligned so that the protrusions on the liner are aligned with the recesses in the center bowl.

After insertion into the center bowl, the compressive force on the liner is released 330, thereby allowing the liner to exert an outwardly radial force against the peripheral wall of the center bowl. This expansive force causes the outer surface of the liner and the protrusions to move toward and/or press against the peripheral wall of the center bowl. The protrusions are then guided 340 to engage with the recesses in the peripheral wall. The expansion of the wear liner causes the vertical annular wall to exert a pressure on the peripheral wall of the center bowl. This coupled with the engagement between the protrusions and the recesses help secure the liner in the installed position in the center bowl.

This method 300 can secure the liner in place in the center bowl without the use of welding processes, which, in turn, makes the removal and replacement of the liner easier. For example, to remove the liner when it becomes worn or damaged, a compressive force can be applied, returning the liner to the compressed configuration, and then the liner removed from the center bowl, at which point it can be replaced, repaired, or disposed of. Providing the replaceable wear liner in this snap-in replaceable fashion helps optimize the manufacturing process and also allows users to quickly and efficiently change-out or replace the liner when appropriate.

This application describes embodiments and examples of protective wear liners for rail car bolster center bowls, but it is meant to be illustrative and not limiting. Those skilled in the art will recognize that the described examples could be modified and/or combined with one another without departing from the scope described herein. Further, features of one embodiment or example may be combined with features of other embodiments or examples to provide still further embodiments or examples as desired. All references that this application cites, discusses, identifies, or refers to are hereby incorporated by reference in their entirety.

What is claimed is:

1. A wear liner for installation in a center bowl of a bolster, the wear liner comprising:

a band having opposing first and second edges, the band being wound to form a vertical annular wall having upper and lower rims, and inward and outward surfaces; and at least one protrusion extending outwardly from the vertical annular wall, the at least one protrusion configured to engage with a recess in the center bowl to secure the liner within the center bowl;

wherein the wear liner has a neutral configuration when no compressive forces are applied to the wear liner, the first and second edges of the band defining a separation in the vertical annular wall in the neutral configuration, wherein the wear liner is compressible to a compact configuration, wherein the separation in the vertical annular wall defined by the first and second edges of the band is smaller in the compact configuration than that of the neutral configuration, and wherein the wear liner, upon being placed in the center bowl and released from the compact configuration, is configured to expand so that the at least one protrusion engages with the recess in the center bowl.

2. The wear liner of claim 1, wherein the at least one protrusion extends from the lower rim of the vertical annular wall, away from the outward surface.

3. The wear liner of claim 1, wherein the at least one protrusion comprises a plurality of protrusions spaced apart about the perimeter of the outward surface.

4. The wear liner of claim 1, wherein the vertical annular wall is configured, upon installation into the center bowl, to exert a radially outward force against a peripheral wall of the center bowl.

5. The wear liner of claim 4, wherein an outer diameter of the wear ring in the neutral configuration is greater than an inner diameter of the center bowl.

6. The wear liner of claim 5, wherein the center bowl comprises a vertical notch in a peripheral wall of the center bowl, the notch groove configured to receive the anti-rotation tabs to inhibit rotation of the wear liner upon installation.

7. The wear liner of claim 1, wherein the center bowl comprises a plurality of recesses, wherein individual protrusions of the wear liner are configured to engage with individual recesses among the plurality of recesses.

8. The wear liner of claim 1, wherein the vertical annular wall in the neutral configuration forms an open ring shape, wherein the separation between the first and second edges forms a separation in the split ring.

9. The wear liner of claim 1, wherein the recess in the center bowl includes a peripheral groove circumscribing a lower surface of a peripheral wall of the center bowl, the peripheral groove configured to engage with the at least one protrusion to inhibit vertical displacement of the wear liner upon installation.

10. The wear liner of claim 1, wherein the first and second edges of the band include anti-rotation tabs that extend away from the outer surface of the vertical annular wall.

11. The wear liner of claim 1, wherein the wear liner is configured to be installed and secured in the center bowl without welding.

12. The wear liner of claim 11, wherein the wear liner configured to be removed from the center bowl by compressing the wear vertical annular wall so that the outer diameter of the wear liner in the compressed state is less than the inner diameter of the center bowl.

13. A railway vehicle bolster comprising:

a center bowl configured to engage with a corresponding mating component of a car body, the center bowl having a peripheral wall encircling a lower bowl surface, the peripheral wall including at least one recess; and a wear liner configured to be installed in the center bowl, the wear liner including:

a band having opposing first and second edges, the band being wound to form a vertical annular wall; and at least one protrusion extending outwardly from the vertical annular wall, the at least one protrusion configured to engage with the recess in the center bowl;

wherein the wear liner has a neutral configuration with no external forces are applied to the wear liner, the first and second edges of the band defining a separation in the vertical annular wall in the neutral configuration, wherein the wear liner is compressible to a compact configuration, such that the separation in the vertical annular wall defined by the first and second edges of the band in the compact configuration is smaller than that of the neutral configuration, and wherein the wear liner, upon being placed in the center bowl and released from the compact configuration, is configured to expand so that the at least one protrusion extends into the recess in the center bowl.

14. The railway vehicle bolster of claim 13, wherein the at least one recess in the center bowl is positioned at a junction between the peripheral wall and the lower bowl surface, and wherein the at least one protrusion extends from the lower rim of the vertical annular wall, away from the outward surface.

15. The railway vehicle bolster of claim 14, wherein the at least one protrusion comprises a plurality of protrusions spaced apart about the perimeter of the outward surface.

16. The railway vehicle bolster of claim 15, wherein the center bowl comprises a plurality of recesses, wherein individual protrusions of the wear liner are configured to engage with individual recesses among the plurality of recesses.

17. The railway vehicle bolster of claim 15, wherein the recess in the center bowl includes a peripheral groove circumscribing a lower surface of a peripheral wall of the center bowl, the peripheral groove configured to engage with the at least one protrusion to inhibit vertical displacement of the wear liner upon installation.

18. The railway vehicle bolster of claim 13, wherein the vertical annular wall, upon installation into the center bowl, exerts a radially outward force against the peripheral wall of the center bowl.

19. The railway vehicle bolster of claim 13, wherein the first and second edges of the band include anti-rotation tabs that extend away from the outer surface of the vertical annular wall, and wherein the center bowl comprises a vertical notch in the peripheral wall, the notch groove configured to receive the anti-rotation tabs to inhibit rotation of the wear liner upon installation.

20. A method of installing a wear liner in a center bowl that is configured to engage with a corresponding mating component of a car body, the center bowl having a peripheral wall with at least one recess, and the wear liner having a vertical annular wall with a gap defined between two wall ends and at least one protrusion extending outwardly from the vertical annular wall, the method comprising:

compressing the wear liner by pressing the two wall ends toward one another to reduce the size of the gap and the outer diameter of the vertical annular wall;

inserting the wear liner into the center bowl;

release the wear liner to effect expansion of the wear liner; and guiding the at least one protrusion extending outwardly from the vertical annular wall to engage with the at least one recess of the peripheral wall of the center bowl, wherein the expansion of the wear liner causes the vertical annular wall to exert a pressure on the peripheral wall of the center bowl.

* * * * *